US008555432B2

(12) United States Patent
Lavin

(10) Patent No.: US 8,555,432 B2
(45) Date of Patent: Oct. 15, 2013

(54) SINGLE PATIENT DISPOSABLE LIFT STRAP DEVICE AND METHOD TO USE THE DEVICE

(71) Applicant: Manuel Sierra Lavin, Belleville, MI (US)

(72) Inventor: Manuel Sierra Lavin, Belleville, MI (US)

( * ) Notice: Subject to any disclaimer, the term of this patent is extended or adjusted under 35 U.S.C. 154(b) by 0 days.

(21) Appl. No.: 13/728,135

(22) Filed: Dec. 27, 2012

(65) Prior Publication Data

US 2013/0160204 A1 Jun. 27, 2013

Related U.S. Application Data

(60) Provisional application No. 61/580,501, filed on Dec. 27, 2011.

(51) Int. Cl.
*A61G 7/10* (2006.01)

(52) U.S. Cl.
USPC ..... 5/81.1 T; 5/81.1 R

(58) Field of Classification Search
USPC ..... 5/89.1, 83.1, 81.1 R, 81.1 T
See application file for complete search history.

(56) References Cited

U.S. PATENT DOCUMENTS 5,165,122 A * 11/1992 Phalen ..... 5/81.1 T
5,685,033 A 11/1997 Lavin
6,901,612 B2 * 6/2005 Calfas et al. ..... 5/81.1 T

* cited by examiner

*Primary Examiner* — Fredrick Conley
(74) *Attorney, Agent, or Firm* — Jelic Patent Services, LLC; Stanley E. Jelic

(57) ABSTRACT

A lift strap device and method of use for a human patient. The device and method are configured for single-use applications with disposable materials. The device comprises: a main support member consisting of a Velcro® (or the like) compatible fabric and adapted for positioning above a person's knee or below the person's knee; one or more Velcro® (or the like) surfaces secured to the bottom of the main support member; nylon webbing (or the like) secured to the bottom of the main support member; and one or more eye member(s) secured to the top of the main support member and the nylon webbing (or the like), wherein the eye member(s) has a plurality of eyelets enabling device attachment at a plurality of patient leg lift settings.

11 Claims, 12 Drawing Sheets

SINGLE PATIENT DISPOSABLE LIFT STRAP DEVICE AND METHOD TO USE THE DEVICE

CROSS-REFERENCE TO RELATED APPLICATIONS

This is a US non-provisional utility application claiming the benefit of U.S. provisional application 61/580501, filed Dec. 27, 2011, which is herein incorporated by reference in its entirety.

FIELD OF THE INVENTION

This disclosure is in the field of medical devices and methods for patient care. More particularly, it is in the field of straps and other patient retention devices and methods.

BACKGROUND OF THE INVENTION

Currently, patient lift straps exist for bed-ridden patients as described in U.S. Pat. No. 5,685,033 to Lavin. The straps are utilized by securing a strap to each leg of the person while the person is lying in bed; securing each strap to a lift bar of a lifting device; raising the lift bar of the lifting device so as to raise only the lower portion of the person from the bed, thereby permitting a caregiver to clean or change the person.

BRIEF SUMMARY OF THE INVENTION

This disclosure describes a single patient disposable lift strap device and method to use the device. The device comprises: a main support member consisting of a Velcro® (or the like) compatible fabric and configured for positioning above a person's knee or below the person's knee; one or more Velcro® (or the like) surfaces secured to the bottom of the main support member; nylon webbing (or the like) secured to the bottom of the main support member; and one or more eye member(s) secured to the top of the main support member and the nylon webbing (or the like), wherein the eye member(s) has a plurality of eyelets enabling device attachment at a plurality of patient leg lift settings.

The main support member can be rectangular in shape with a top and bottom side. The thickness is substantially less than the length or width. Different sizes are available to accommodate patients with different leg circumferences. The outside surface is Velcro® (or the like) compatible and can be secured around a patient's leg with the Velcro® (or the like) surfaces. The main support member has a foam interior, which provides padding for patient comfort.

The Velcro® (or the like) surfaces are secured to one side of the bottom of the main support member. The Velcro® (or the like) surfaces can vary in size, conceivably covering one entire side of the bottom of the main support member to maximize the tensile strength of the device.

The nylon webbing is secured to the bottom of the main support member. In one embodiment, the nylon webbing is secured to the main support member with stitching.

The eye member is secured to the top of the main support member and the nylon webbing. In one embodiment, stitching is used to secure the eye member to the nylon webbing, with the main support member held between the eye member and the nylon webbing. One or more eyelets are integral to the eye member to allow patient leg lifting at different heights or settings. In one embodiment, the eye member consists of nylon and is sewn onto the top of the main support member.

The eye member can vary in length to match the requirements of the device method of use. In one embodiment, a shorter eye member(s) would be used to accommodate a limb suspension that required a patient's leg to be elevated at a high height. Conversely in another embodiment, a longer eye member(s) would be used to accommodate a limb suspension that required a patient's leg to be elevated at a low height.

In one embodiment, there is one eye member. In separate embodiment, there are two eye members attached adjacent to each other on the main support member. In a separate embodiment, there are two eye members attached at the same location of the main support member.

The method of using a single patient disposable lift strap device lift a bedridden person comprises: adjusting the bottom of a main support member consisting of a Velcro® compatible fabric and adapted for positioning above a person's knee to the bottom of each of the person's legs; securing the main support members around each of the person's legs using Velcro® which is on one side of the bottom of the main support members; using an eye member, which is secured to the top of the main support member with nylon webbing located at the bottom of the main support member, to attach the device to a lift bar of a lifting apparatus, wherein the eye member consists of a plurality of eyelets capable of providing different lift heights; and raising the lift bar of the lifting apparatus so as to raise only the lower portion of the bedridden person.

The scope of the invention is defined by the claims, which are incorporated into this section by reference. A more complete understanding of embodiments on the present disclosure will be afforded to those skilled in the art, as well as the realization of additional advantages thereof, by consideration of the following detailed description of one or more embodiments. Reference will be made to the appended sheets of drawings that will first be described briefly.

DETAILED DESCRIPTION OF THE INVENTION

The lift strap device for attachment to a leg of a person described in U.S. Pat. No. 5,685,033 comprises: a main support member, said main support member adapted for positioning above said person's knee; a wire eye member secured to said main support member, said eye member projecting away from said support member; and means, secured to said support member, for securing said main support member to said person, said means comprising: a first strap member secured to one end of said main support member; and a buckle member fixed to an opposite end of said main support member.

The device described in U.S. Pat. No. 5,685,033 is designed for multiple uses with different patients. Feedback from healthcare institutions regarding the above device, has helped to identify demand for a device which is disposable and designed for a single use or a single patient. Because the device must be single-use capable, it needs to be re-engineered with a different functionality and different materials.

This disclosure describes a single patient disposable lift strap device embodiments and method to use the device embodiments, which fulfill the needs described above.

Three methods are given below for using embodiments of the device: a basic process, double strap process, and single limb suspension.

Figure 16:
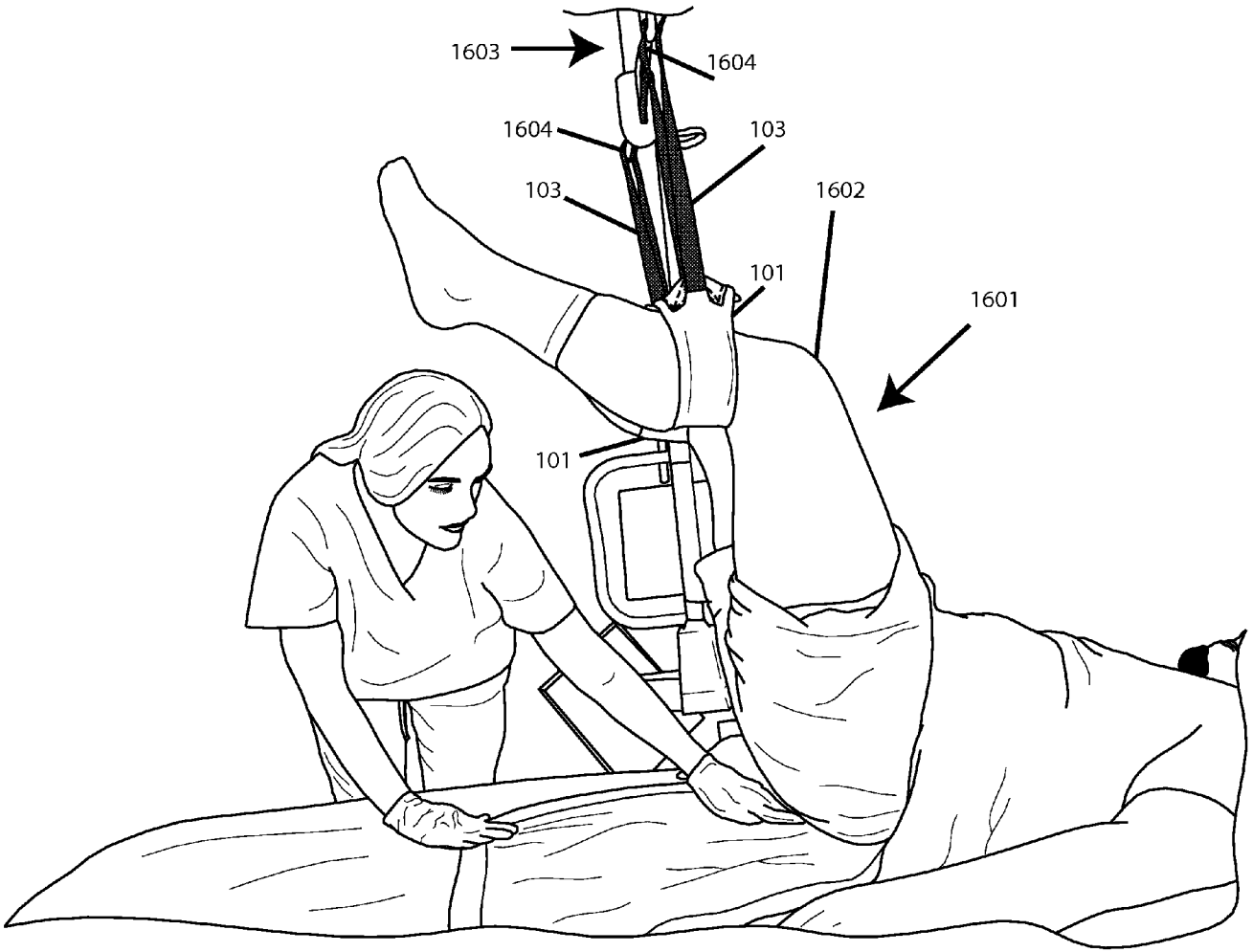
FIG. 16 shows a basic process method embodiment.

Basic Process:

FIG. 16 shows a basic process method embodiment using the device described in this disclosure. Recommended if the caregiver needs to lift patient's hips to access buttocks and lower back for cleaning 1. Measure circumference of leg 1601 below the knee 1602 and choose correct product size.
2. Position main support member 101 below knee.
3. Attach lift strap devices to patient legs 1601 by securing in place with Velcro surfaces not shown.
4. Make sure all eye members 103 are face up.
5. Position patient lift 1603 over the lift strap device(s).
6. Attach loop to T-bar 1604 on lift 1603 at appropriate eyelet 104 length.
7. Push button on lift 1603 to gently raise patient's legs 1601 to correct position.

Figure 17:
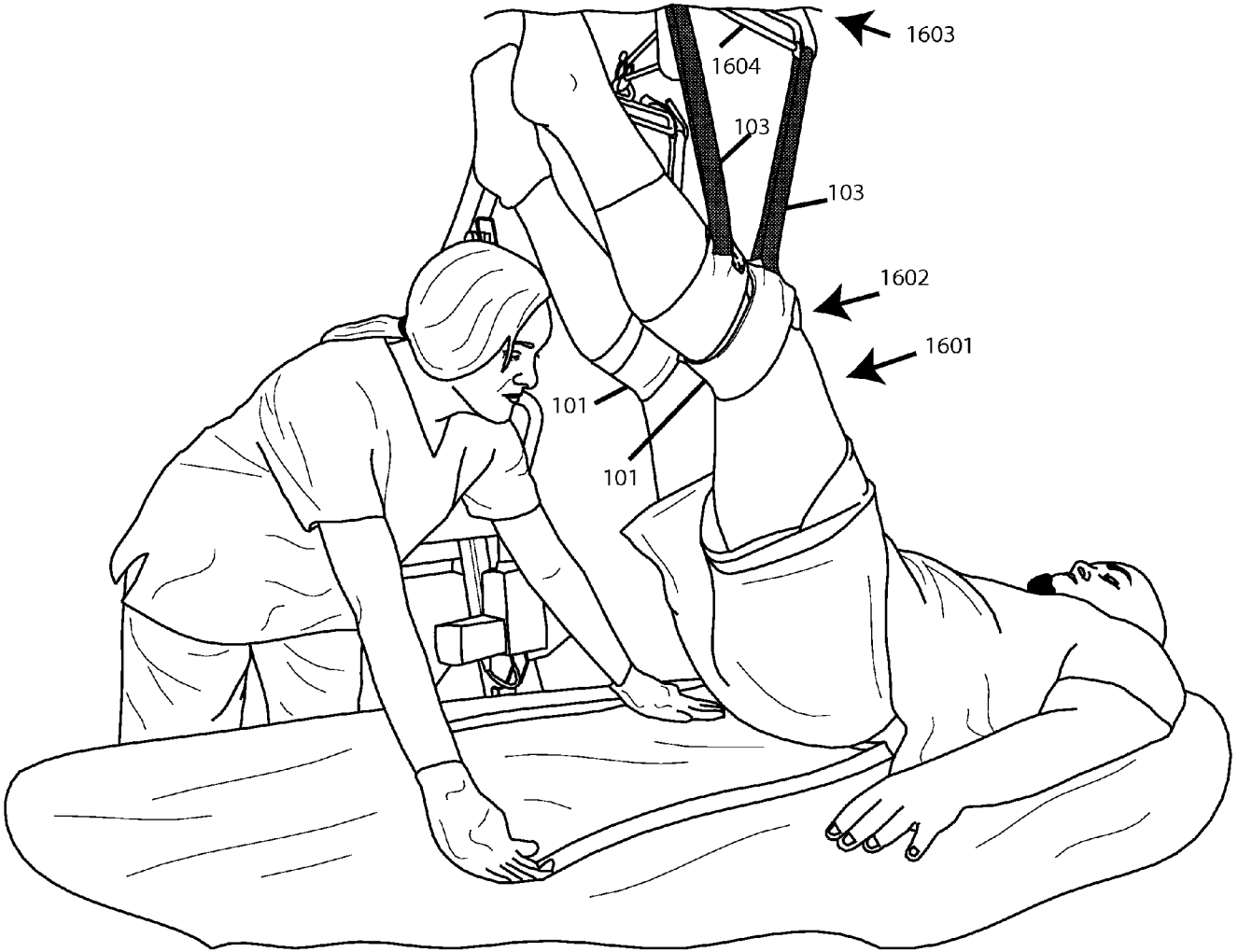
FIG. 17 shows a double strap process method embodiment.

Double Strap Process:

FIG. 17 shows a double lift strap device process method embodiment. Recommended for larger patients, for those with sensitive legs or conditions such as varicose veins, or if caregiver needs to lift patient higher than basic process. Requires 2 sets of straps, one sized to lower leg below knee and one sized to leg above knee.

1. Measure leg 1601 circumference at both above and below knee 1602 and choose correct product size.
2. Position one pair of main support members 101 above the knee 1602, and the other pair of main support members 101 below the knee 1602. Make sure all eye members 103 are face up.
3. Position patient lift 1603 above patient's knees 1602.
4. Attach loop to T-bar 1604 on lift 1603 at appropriate eyelet 104 length.
5. Push button on lift 1603 to gently raise patient's legs 1601 to correct position.

Figure 18:
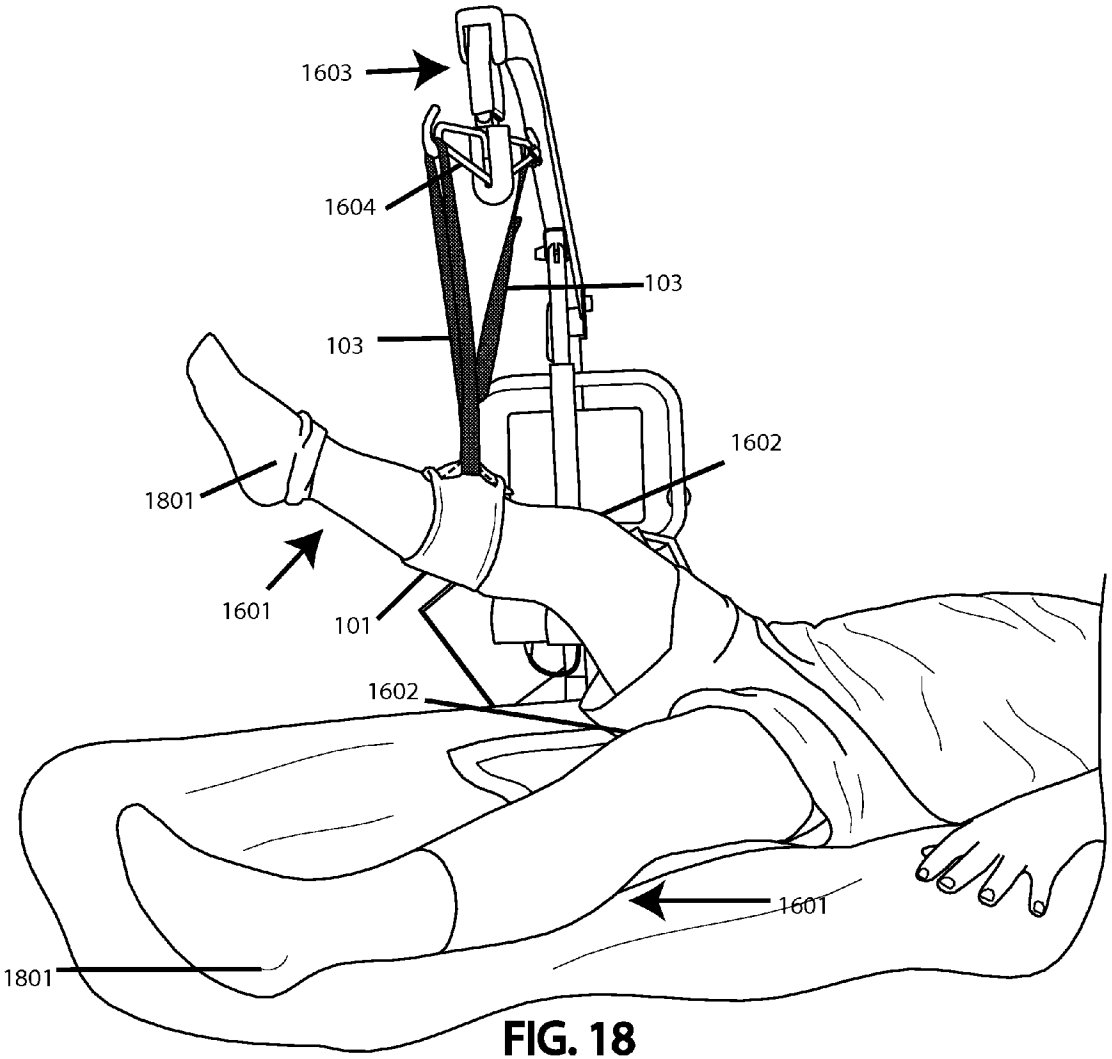
FIG. 18 shows a single limb suspension method embodiment.

Single Limb Suspension:

FIG. 18 shows a lift strap device single limb suspension method embodiment. Recommended for procedures where only one limb needs to be lifted. Be sure to use both T-bar connector adapters.

1. Select lift strap device(s) with eye member(s) 103 length which matches the requirements of the limb suspension. Use short eye member 103 lengths for high elevation requirements and long eye member 103 lengths for low elevation requirements.
2. Measure circumference of leg 1601 at appropriate area of patient's leg 1601 depending on procedural needs, (between knee 1602 and ankle 1801).
3. Position a single lift strap device to desired area on patient's leg 1601 depending on procedural needs. Do not place lift strap device on knee joint or neck.
4. Make sure all eye members 103 are face up.
5. Position patient lift 1603 over lift strap device.
6. Attach $2^{nd}$ T-bar connector to eye members 103 on lift strap device closest to main support members 101 using carabineer clip.
7. Attach longest eye members 103 to T-bar 1604 on lift 1603 at appropriate eye members 103 length.
8. Push button on lift to gently raise patient's leg 1601 to desired height.

Figure 1:
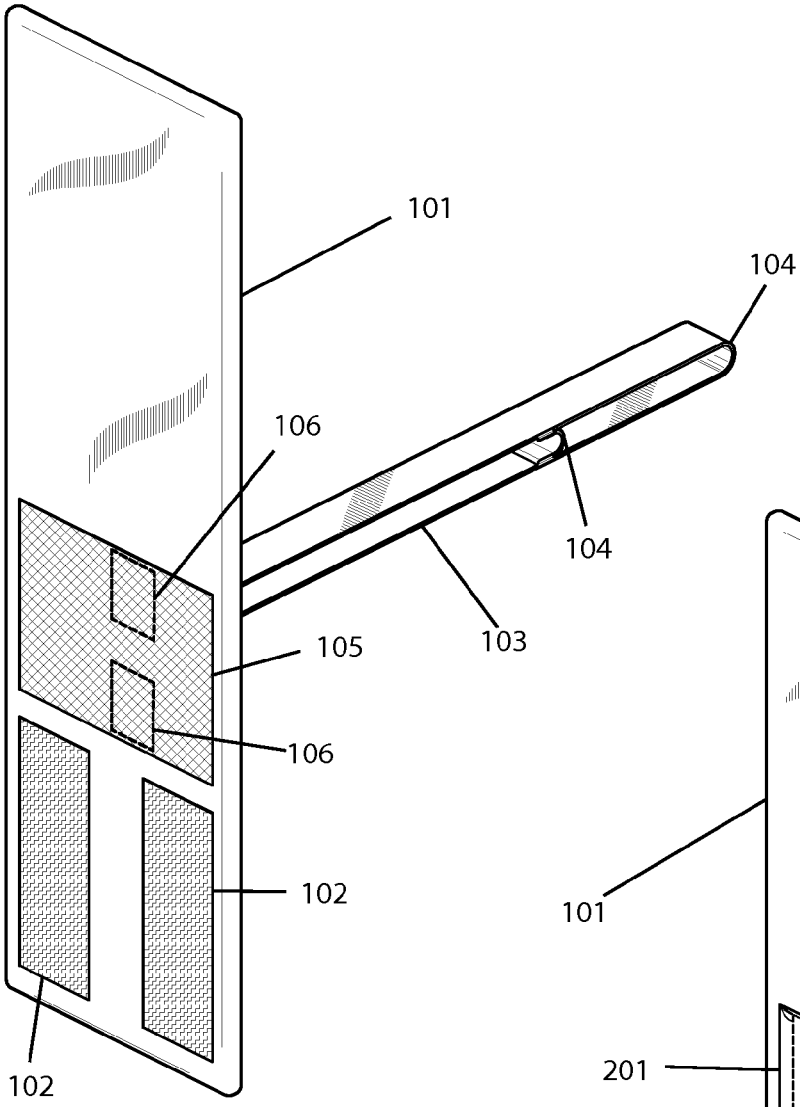
FIG. 1 is a bottom perspective view of an embodiment with one eye member.

FIG. 1 is a bottom perspective view of an embodiment with one eye member. A main support member 101 has two Velcro® surfaces 102 secured to the bottom of the main support member 101. An eye member 103 is secured to the top of the main support member 101 with two eyelets 104 shown. Nylon webbing 105 is secured to the bottom of the main support member 101. Eye member stitching 106 secures the eye member 103 to the nylon webbing 105 and holds the main support member 101 in place.

Figure 2:
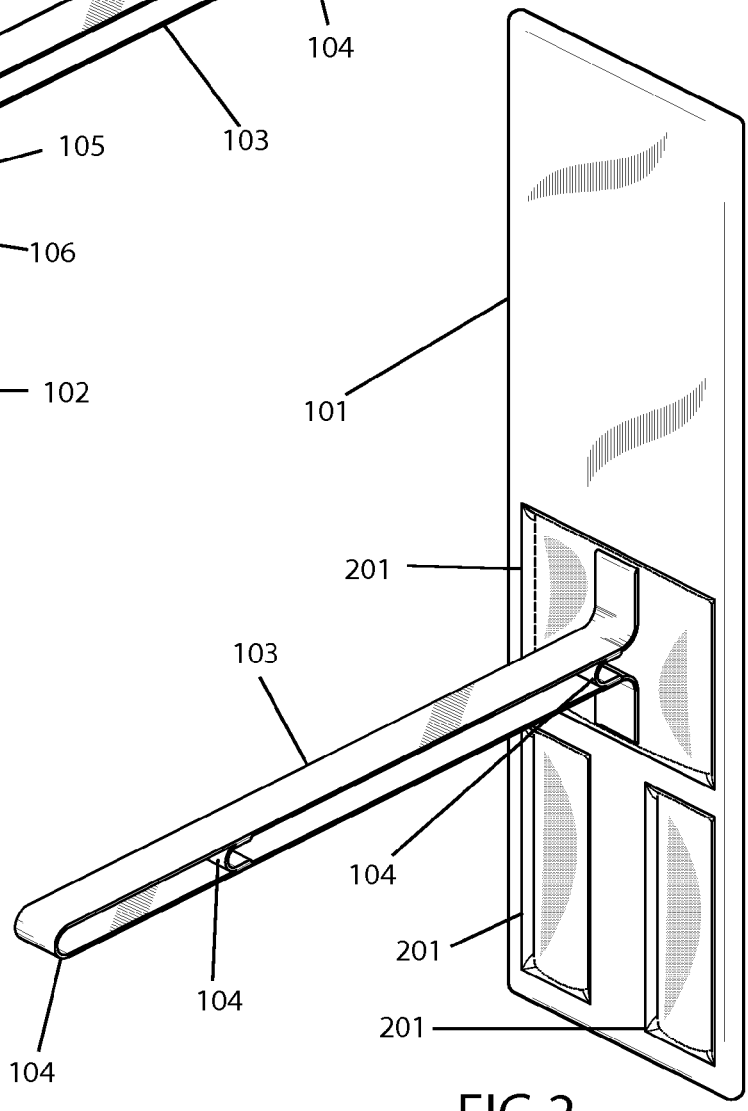
FIG. 2 is a top perspective view of an embodiment with one eye member.

FIG. 2 is a top perspective view of an embodiment with one eye member. A main support member 101 has stitching 201 on the top of the main support member 101 to secure the two Velcro® surfaces on the bottom (not shown). An eye member 103 is secured to the top of the main support member 101 and three eyelets 104 are shown.

Figure 3:
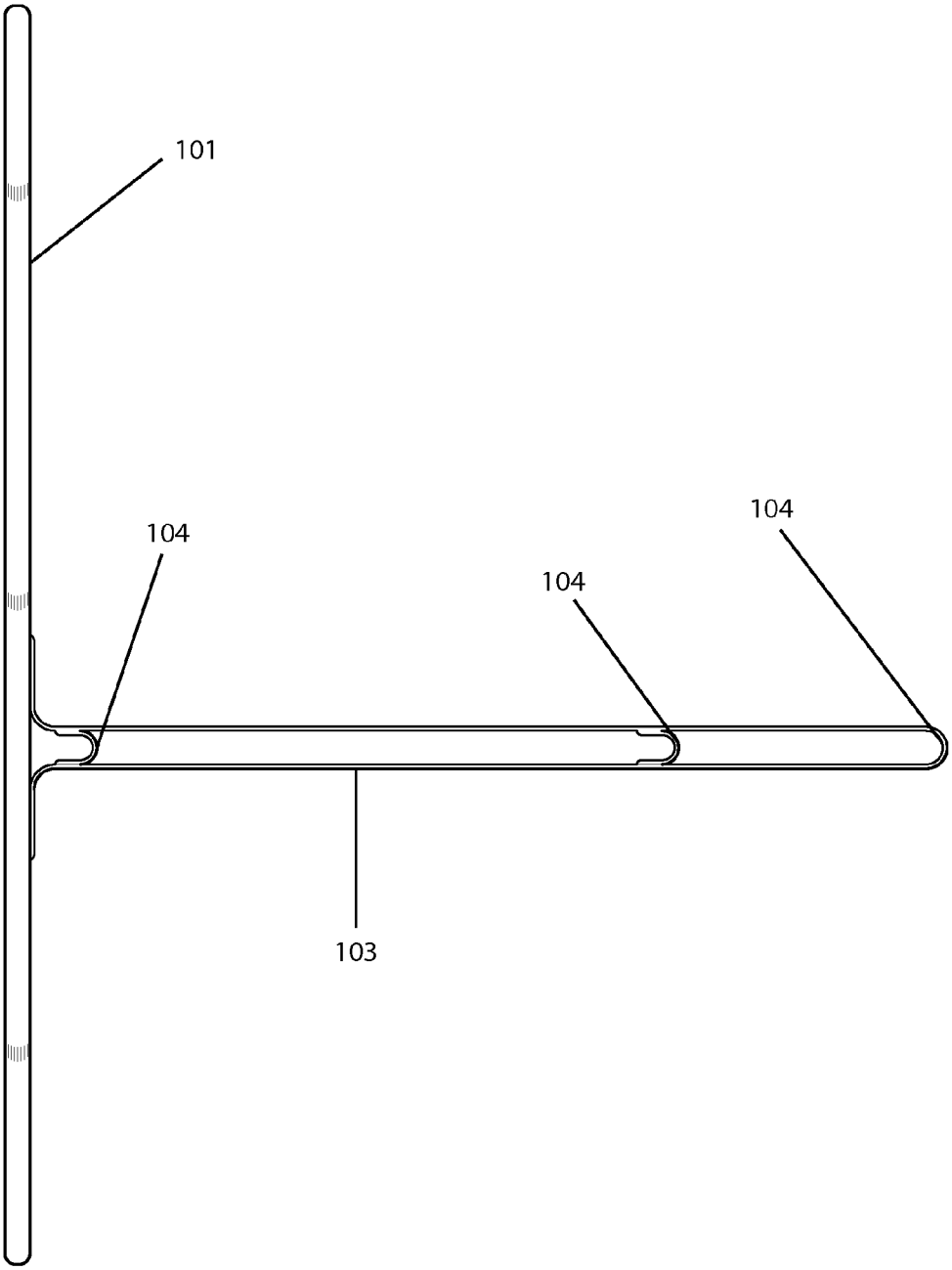
FIG. 3 is a side view of the an embodiment with one eye member.

FIG. 3 is a side view of an embodiment with one eye member. An eye member 103 is secured to the top of the main support member 101 and three eyelets 104 are shown.

Figure 4:
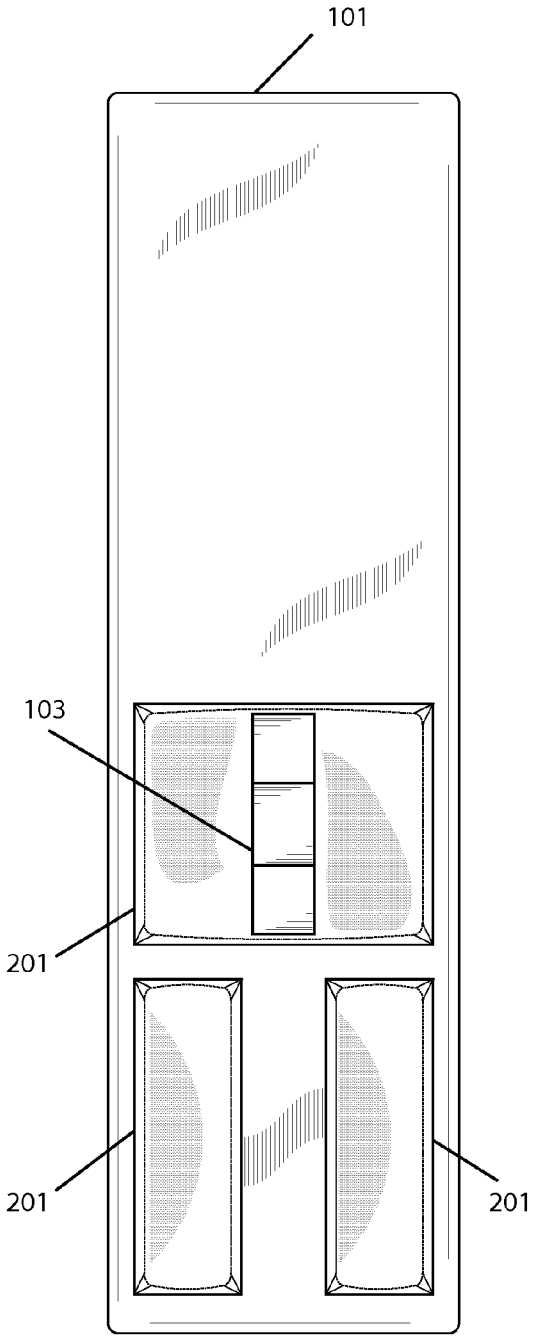
FIG. 4 is a top view of an embodiment with one eye member.

FIG. 4 is a top view of an embodiment with one eye member. A main support member 101 has stitching 201 on the top of the main support member 101 to secure the two Velcro® surfaces on the bottom (not shown). An eye member 103 is secured to the top of the main support member 101 (the eyelets 104 are not shown).

Figure 5:
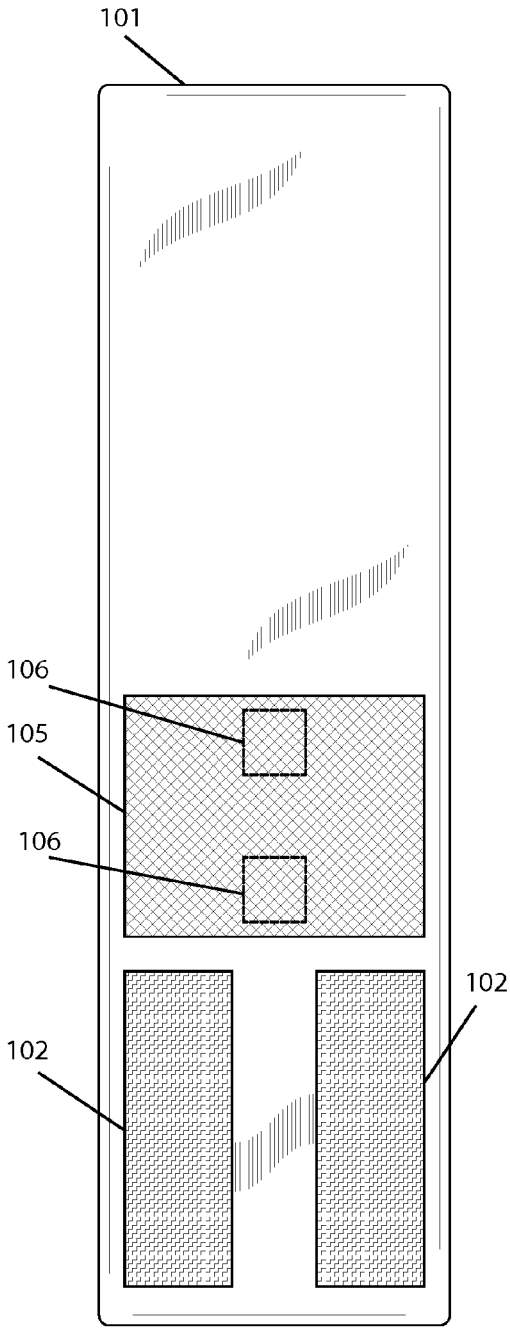
FIG. 5 is a bottom view of an embodiment with one eye member.

FIG. 5 is a bottom view of an embodiment with one eye member. A main support member 101 has two Velcro® surfaces 102 to the bottom of the main support member 101. Nylon webbing 105 is secured to the bottom of the main support member 101. Eye member stitching 106 secures the eye member (not shown) to the nylon webbing 105 and holds the main support member 101 in place.

Figure 6:
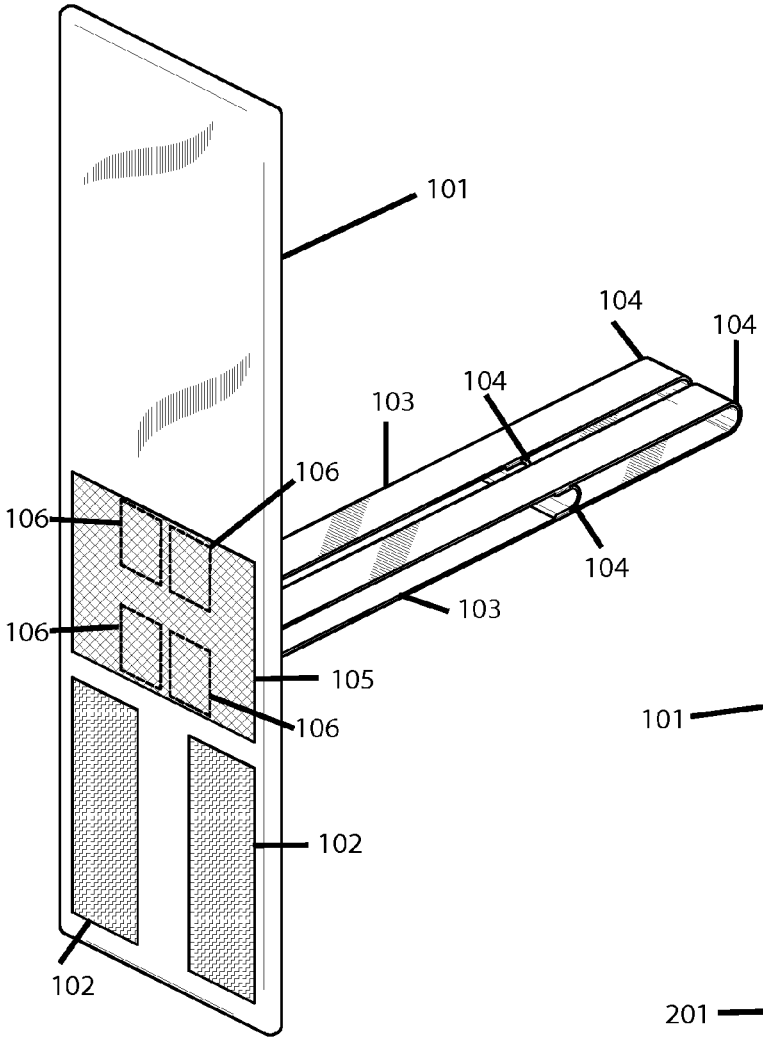
FIG. 6 is a bottom perspective view of an embodiment with two eye members attached adjacent to each other on the main support member.

FIG. 6 is a bottom perspective view of an embodiment with two eye members attached adjacent to each other on the main support member. A main support member 101 has two Velcro® surfaces 102 secured to the bottom of the main support member 101. Two eye members 103 are secured adjacent to each other on the top of the main support member 101 with two eyelets 104 shown. Nylon webbing 105 is secured to the bottom of the main support member 101. Eye member stitching 106 secures the eye members 103 to the nylon webbing 105 and holds the main support member 101 in place.

Figure 7:
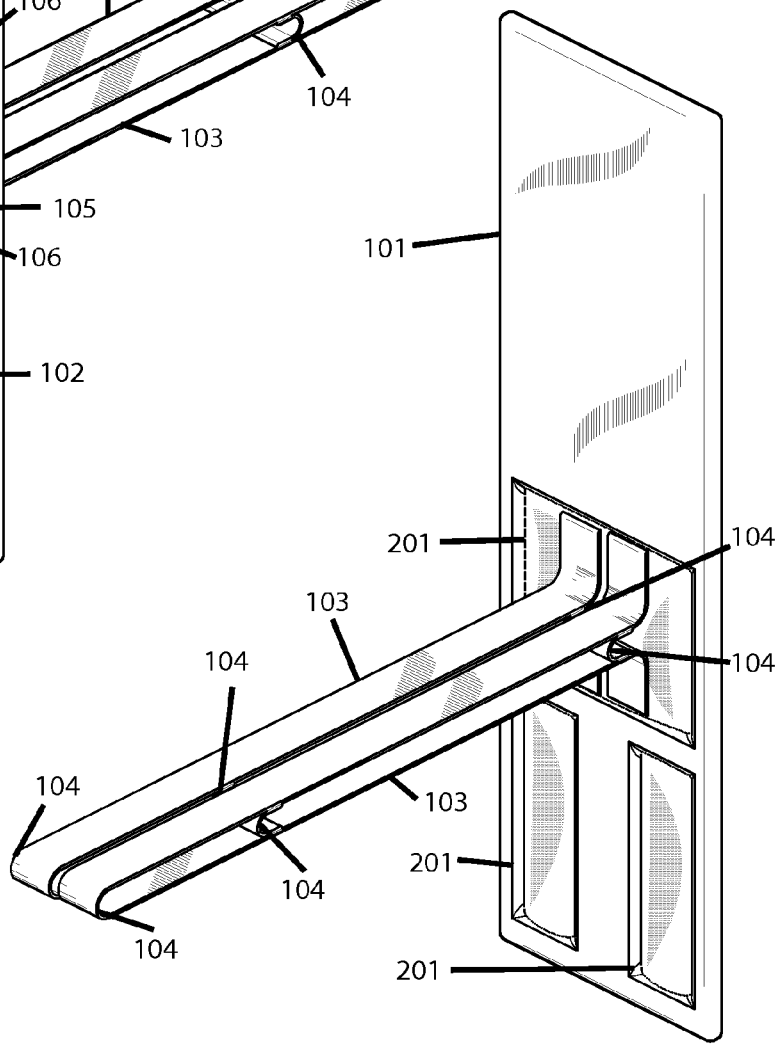
FIG. 7 is a top perspective view of an embodiment with two eye members attached adjacent to each other on the main support member.

FIG. 7 is a top perspective view of an embodiment with two eye members attached adjacent to each other on the main support member. A main support member 101 has stitching 201 on the top of the main support member 101 to secure the two Velcro® surfaces on the bottom (not shown). Two eye members 103 are secured adjacent to each other on the top of the main support member 101 and three eyelets 104 are shown.

Figure 8:
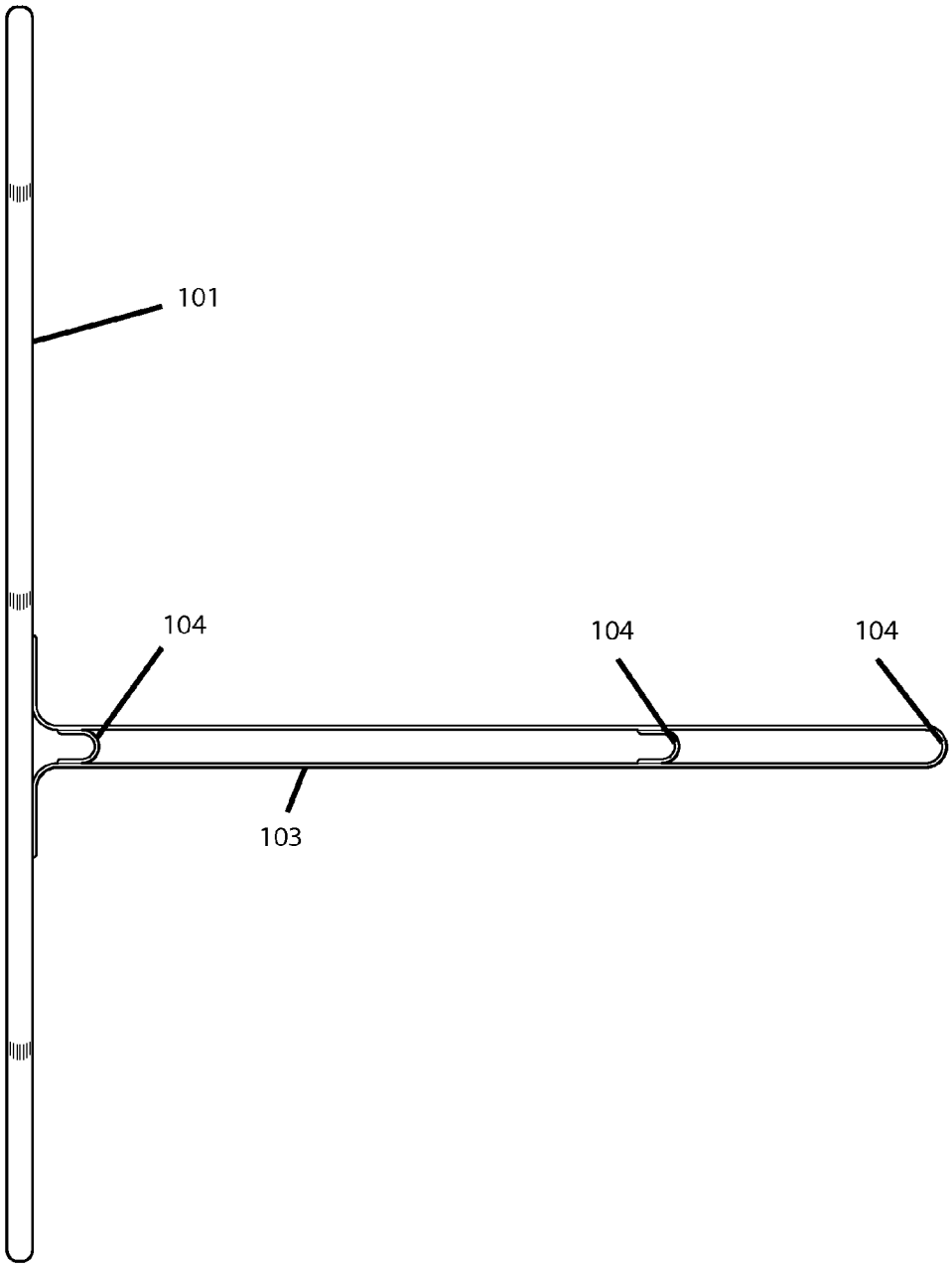
FIG. 8 is a side view of the an embodiment with two eye members attached adjacent to each other on the main support member.

FIG. 8 is a side view of the an embodiment with two eye members attached adjacent to each other on the main support member. The eye members 103 are secured adjacent to each other on the top of the main support member 101 and three eyelets 104 are shown.

Figure 9:
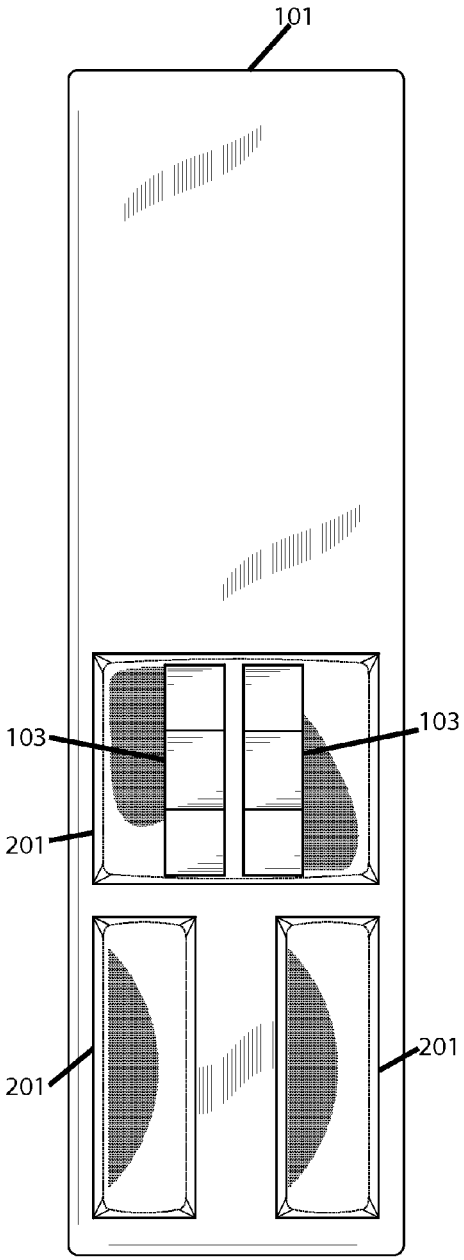
FIG. 9 is a top view of an embodiment with two eye members attached adjacent to each other on the main support member.

FIG. 9 is a top view of an embodiment with two eye members attached adjacent to each other on the main support member. A main support member 101 has stitching 201 on the top of the main support member 101 to secure the two Velcro® surfaces on the bottom (not shown). The eye members 103 are secured adjacent to each other on the top of the main support member 101 (the eyelets 104 are not shown).

Figure 10:
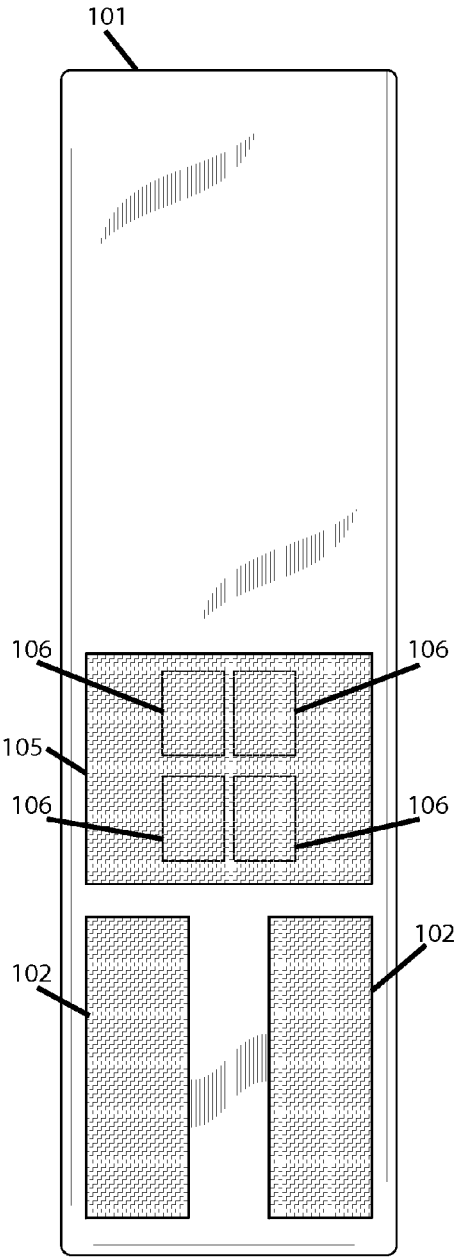
FIG. 10 is a bottom view of an embodiment with two eye members attached adjacent to each other on the main support member.

FIG. 10 is a bottom view of an embodiment with two eye members attached adjacent to each other on the main support member. A main support member 101 has two Velcro® surfaces 102 to the bottom of the main support member 101. Nylon webbing 105 is secured to the bottom of the main support member 101. Eye member stitching 106 secures the eye members (not shown) to the nylon webbing 105 and holds the main support member 101 in place.

Figure 11:
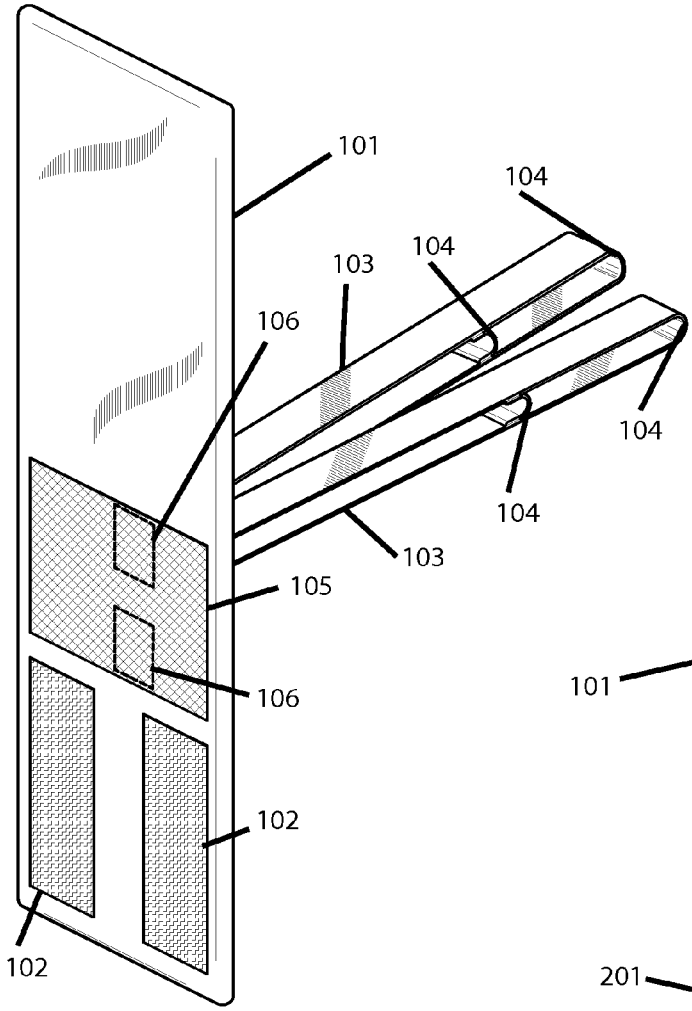
FIG. 11 is a bottom perspective view of an embodiment with two eye members attached at the same location of the main support member.

FIG. 11 is a bottom perspective view of an embodiment with two eye members attached at the same location of the main support member. A main support member 101 has two Velcro® surfaces 102 secured to the bottom of the main support member 101. Two eye members 103 are secured at the same location of the top of the main support member 101 with two eyelets 104 shown. Nylon webbing 105 is secured to the bottom of the main support member 101. Eye member stitching 106 secures the eye members 103 to the nylon webbing 105 and holds the main support member 101 in place.

Figure 12:
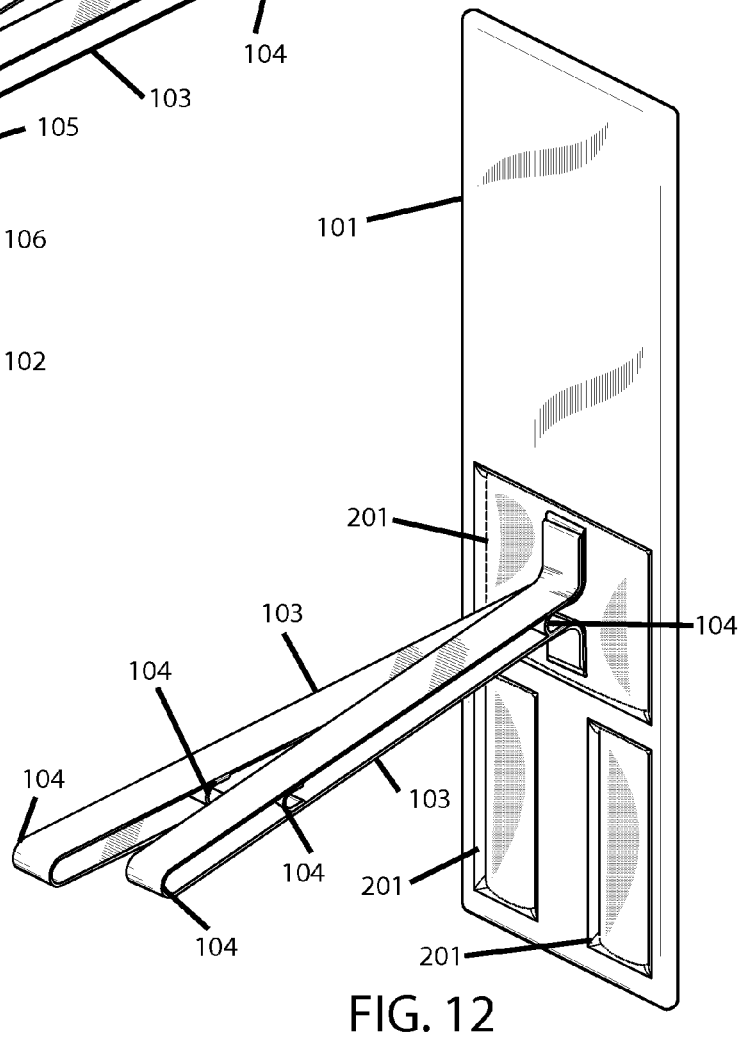
FIG. 12 is a top perspective view of an embodiment with two eye members attached at the same location of the main support member.

FIG. 12 is a top perspective view of an embodiment with two eye members attached at the same location of the main support member. A main support member 101 has stitching 201 on the top of the main support member 101 to secure the two Velcro® surfaces on the bottom (not shown). Two eye members 103 are secured at the same location of the main support member 101 and three eyelets 104 are shown.

Figure 13:
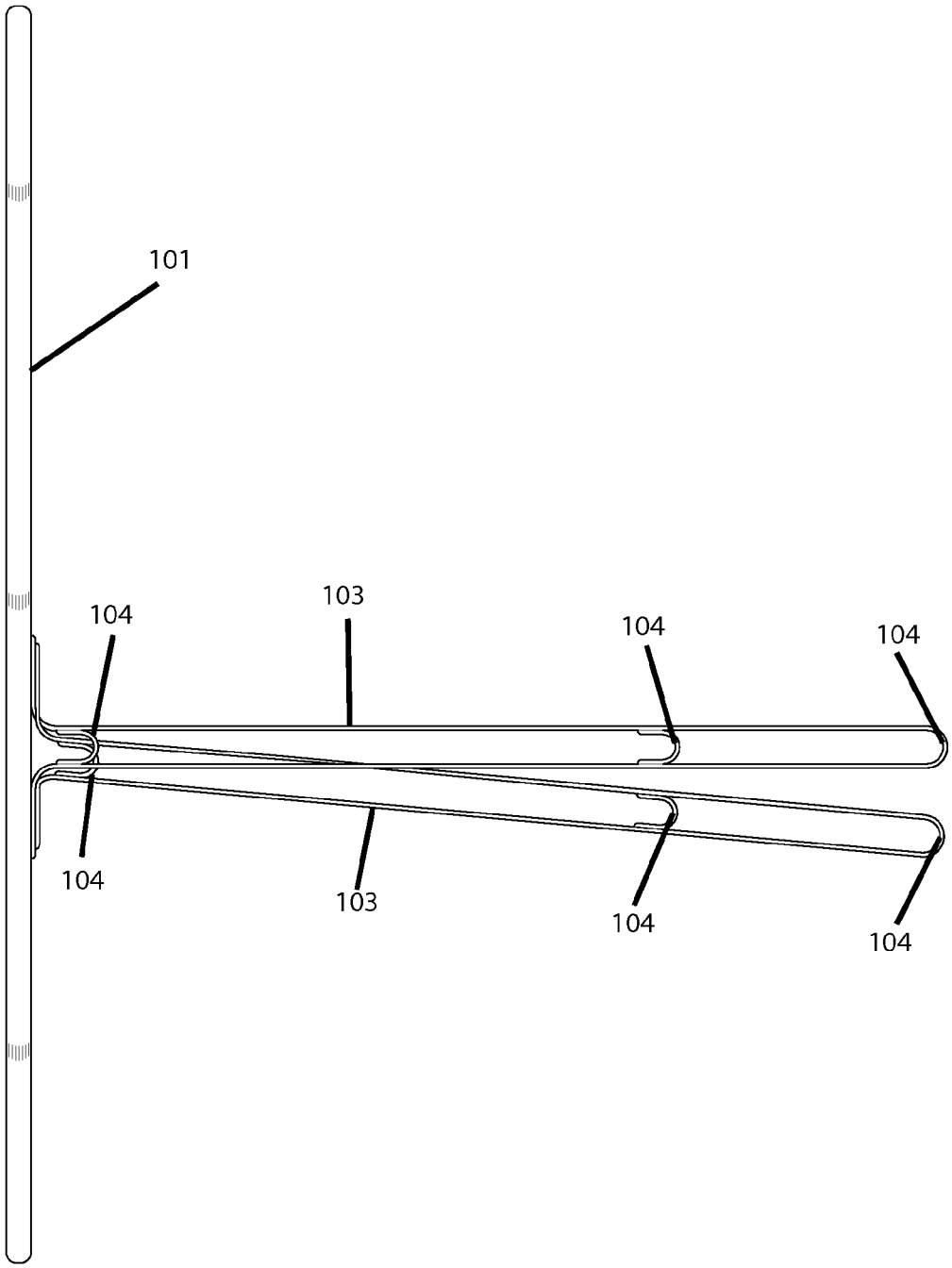
FIG. 13 is a side view of the an embodiment with two eye members attached at the same location of the main support member.

FIG. 13 is a side view of the an embodiment with two eye members attached at the same location of the main support member. The eye members 103 are secured at the same location of the top of the main support member 101 and three eyelets 104 are shown.

Figure 14:
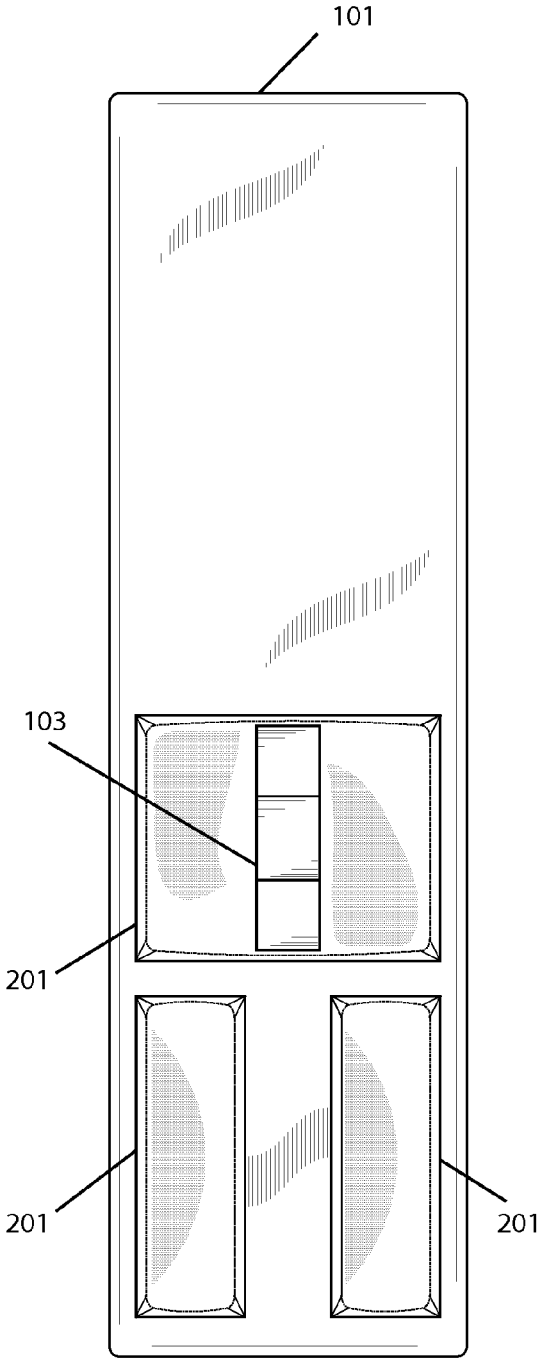
FIG. 14 is a top view of an embodiment with two eye members attached at the same location of the main support member.

FIG. 14 is a top view of an embodiment with two eye members attached at the same location of the main support member. A main support member 101 has stitching 201 on the top of the main support member 101 to secure the two Velcro® surfaces on the bottom (not shown). The eye members 103 are secured at the same location of the main support member 101 (the eyelets 104 are not shown).

Figure 15:
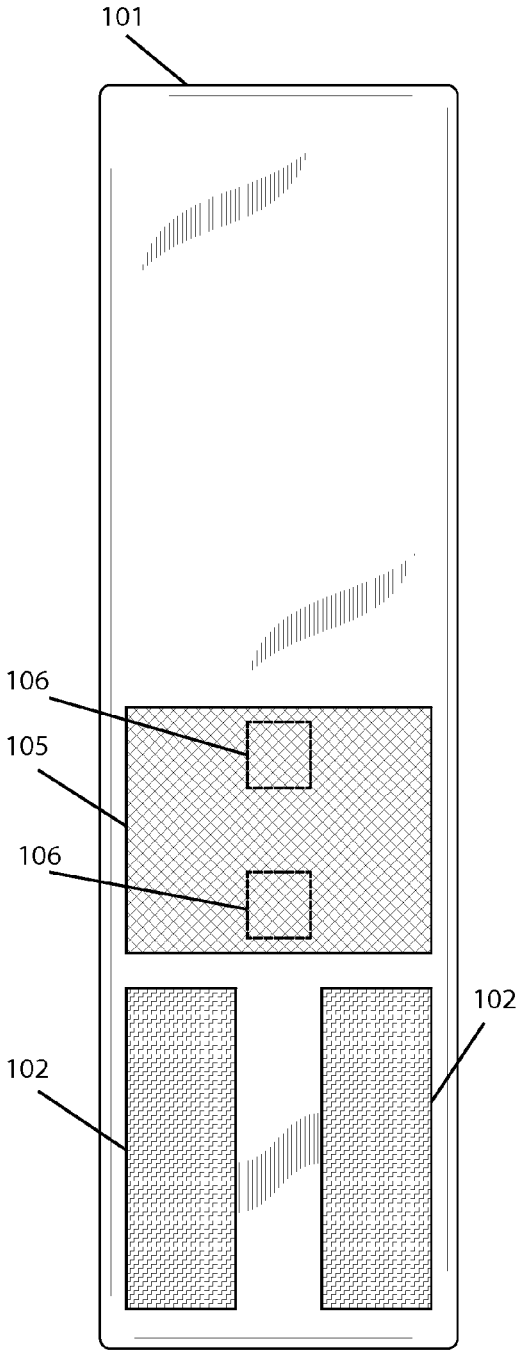
FIG. 15 is a bottom view of an embodiment with two eye members attached at the same location of the main support member.

FIG. 15 is a bottom view of an embodiment with two eye members attached at the same location of the main support member. A main support member 101 has two Velcro® surfaces 102 to the bottom of the main support member 101. Nylon webbing 105 is secured to the bottom of the main support member 101. Eye member stitching 106 secures the eye members (not shown) to the nylon webbing 105 and holds the main support member 101 in place.

This disclosure is enabling to those of ordinary skill in the art, while maintaining adequate flexibility for reasonable adaptation. Moreover, those skilled in the art will appreciate variations of the examples and principles described herein, which are also intended to be within the scope of the present invention. Any references herein to "the invention" or the like are thus intended in this spirit.

I claim:

1. A method of using four single patient disposable lift strap devices to lift a bedridden person, the method comprising:

adjusting a bottom of a device main support member consisting essentially of a hook and loop fastener compatible fabric and configured for positioning above and below a person's knee to the bottom of each of the person's legs, wherein two devices are positioned on each leg and one device is above the knee and one device is below the knee;

securing the main support members around each of the person's legs using hook and loop fasteners which are on one side of the bottom of the main support members;

using one or more eye member(s), which is secured to the top of the main support member with nylon webbing located at the bottom of the main support member, to attach the device to a lift bar of a lifting apparatus, wherein the eye member consists of a plurality of eyelets capable of providing different lift heights; and raising the lift bar of the lifting apparatus so as to raise only the lower portion of the bedridden person.

2. The method of claim 1, wherein the one or more eye member(s) consists of a single eye member.

3. The method of claim 1, wherein the one or more eye member(s) consists of two eye members attached adjacent to each other on the main support member.

4. The method of claim 1, wherein the one or more eye member(s) consists of two eye members attached at the same location of the main support member.

5. A method of using two single patient disposable lift strap devices to lift a bedridden person, the method comprising:

adjusting a bottom of a device main support member consisting essentially of a hook and loop fastener compatible fabric and configured for positioning below a person's knee to the bottom of each of the person's legs, wherein each device main support member corresponds to one leg;

securing the main support members around each of the person's legs using hook and loop fasteners which are on one side of the bottom of the main support members;

using one or more eye member(s), which is secured to the top of the main support member with nylon webbing located at the bottom of the main support member, to attach the device to a lift bar of a lifting apparatus, wherein the eye member consists of a plurality of eyelets capable of providing different lift heights; and raising the lift bar of the lifting apparatus so as to raise only the lower portion of the bedridden person.

6. The method of claim 5, wherein the one or more eye member(s) consists of a single eye member.

7. The method of claim 5, wherein the one or more eye member(s) consists of two eye members attached adjacent to each other on the main support member.

8. The method of claim 5, wherein the one or more eye member(s) consists of two eye members attached at the same location of the main support member.

9. A method of using a single patient disposable lift strap device(s) to lift a leg of a bedridden person, the method comprising:

Selecting said lift strap device(s) with an eye member(s) length which matches an elevation requirement for the leg;

adjusting a bottom of a device main support member consisting essentially of a hook and loop fastener compatible fabric and configured for positioning below a person's knee to the bottom of the person's leg;

securing the main support member around the person's leg using hook and loop fasteners which are on one side of the bottom of the main support member;

using two eye members, which are secured to the top of the main support member with nylon webbing located at the bottom of the main support member, to attach the device to each side of a lift bar of a lifting apparatus, wherein the eye member consists of a plurality of eyelets capable of providing different lift heights; and raising the lift bar of the lifting apparatus so as to raise only the lower portion of the bedridden person.

10. The method of claim 9, wherein the two eye members are attached adjacent to each other on the main support member.

11. The method of claim 9, wherein the two eye members are attached at the same location on the main support member.

* * * * *